United States Patent [19]

Miki et al.

[11] Patent Number: 4,481,926

[45] Date of Patent: Nov. 13, 1984

[54] FUEL INJECTION SYSTEM FOR AN INTERNAL COMBUSTION ENGINE

[75] Inventors: Takao Miki; Yoshiaki Asayama; Yoshiji Ueyama, all of Hyogo, Japan

[73] Assignee: Mitsubishi Denki Kabushiki Kaisha, Tokyo, Japan

[21] Appl. No.: 406,143

[22] Filed: Aug. 9, 1982

[30] Foreign Application Priority Data

Aug. 11, 1981 [JP] Japan ..... 56-126978

[51] Int. Cl.[3] ..... F02M 39/00

[52] U.S. Cl. ..... 123/463; 123/458

[58] Field of Search ..... 123/494, 458, 459, 464, 123/463, 453

[56] References Cited

U.S. PATENT DOCUMENTS

| | | | |
|---|---|---|---|
| 2,378,036 | 6/1945 | Reggio | 123/464 |
| 3,818,877 | 6/1974 | Barrera et al. | 123/494 |
| 4,184,465 | 1/1980 | Nakazeki et al. | 123/463 |
| 4,235,205 | 11/1980 | Fukui et al. | 123/463 |
| 4,338,902 | 7/1982 | Nakamura et al. | 123/458 |
| 4,404,944 | 9/1983 | Yamazaki et al. | 123/463 |

*Primary Examiner*—Charles J. Myhre
*Assistant Examiner*—Carl Stuart Miller
*Attorney, Agent, or Firm*—Sughrue, Mion, Zinn, Macpeak & Seas

[57] ABSTRACT

The fuel injection system for an internal combustion engine includes a fuel injection valve for injecting fuel under pressure into an intake pipe of an engine. A vortex flow meter generates a frequency output signal corresponding to the intake air flow rate for the engine and an injection valve drive means for opening the fuel injection valve for a predetermined period is operated in synchronism with the frequency output signal to effect proper fuel injection. A pressure regulating device is provided for holding substantially at a predetermined level the difference between the pressure of the fuel being fed to the fuel injection valve and the pressure in the intake pipe. An electronic control is provided for controlling the difference pressure in accordance with the running state of the engine.

1 Claim, 1 Drawing Figure

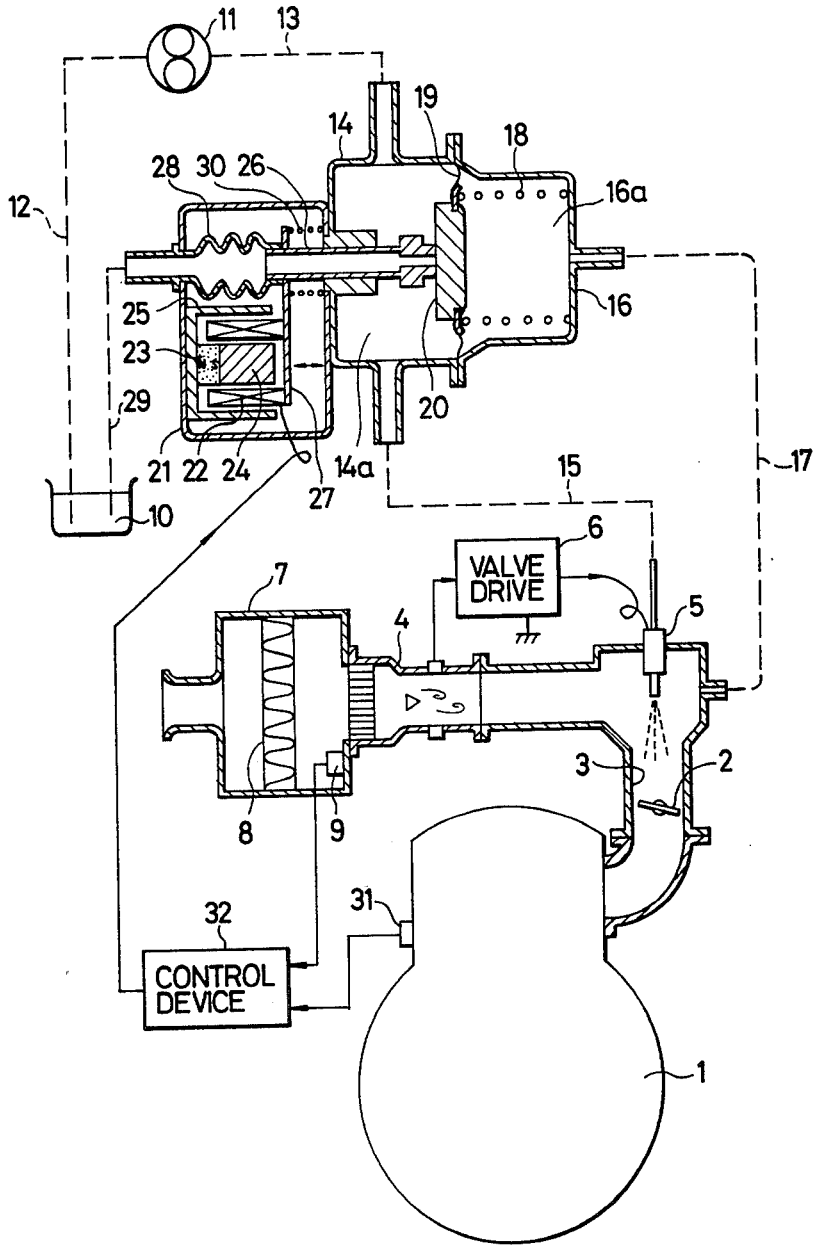
11
13
19
14
18
28
30
26
16a
12
25
16
23
29
20
21
22
24
14a
27
15
17
10
6
VALVE DRIVE
7
5
4
3
2
8
9
32
31
CONTROL DEVICE
1

FUEL INJECTION SYSTEM FOR AN INTERNAL COMBUSTION ENGINE

BACKGROUND OF THE INVENTION

The present invention is directed to a fuel injection system for an internal combustion engine and more particularly to a fuel injection system for an engine which includes a vortex flow meter for measuring the flow rate of the intake air for the engine, a fuel injection valve adapted to be driven in synchronism with the frequency output signal of the vortex flow meter to thereby inject a predetermined amount of fuel and means for controlling the pressure of the fuel to be fed to the fuel injection valve in accordance with the running state of the internal combustion engine.

As is well known in the art, a vortex flow meter generates an output signal having a frequency which corresponds to the vortex velocity (or the velocity of a number of vortices generated) which is proportional to the flow rate of intake air to be metered. The method of supplying a predetermined quantity of fuel to the engine by injection in synchronism with a frequency output signal proportional to the flow rate of the intake air is disclosed in laid-open Japanese Utility Model No. 53-133919 or laid-open Japanese Patent Publication No. 55-5448. According to these disclosures, it is possible to inject the fuel in accordance with an abrupt change in the intake air flow rate during the deceleration of the engine so that the engine has an advantage in that the accelerating performance is excellent. The intake air flow rate of an engine having a displacement of 2,000 cc is about 2 l/s (during the idling operation) to 85 l/s (at the maximum output). On the other hand, the torque fluctuates unless the injection frequency of the fuel injection valve is higher than at least about 10 Hz during the idling operation. As a result, during high speed running operation of the engine, the injection frequency of the aforementioned fuel injection valve necessarily becomes high. Since the injection frequency is high, the period for the injection valve to be opened can not be elongated. This is especially true for the conventional method of compensating the flow rate of the fuel to be fed to the engine by changing the aforementioned open period for the valve in accordance with the running state of the engine wherein the valve open period is remarkably shortened thereby creating a defect in that the metering error of the fuel for a short period is augmented.

SUMMARY OF THE INVENTION

The present invention provides a new and improved fuel injection system for an internal combustion engine wherein the flow rate of fuel to be corrected in accordance with the running state of the engine is determined by changing the fuel injection pressure while the open period of the fuel injection valve is held constant thereby effectively elongating the aforementioned valve open period.

The present invention provides a new and improved fuel injection system for an internal combustion engine comprising a fuel injection valve for injecting fuel under an adjusted pressure into the intake pipe of an engine, a vortex flow meter for generating an output signal at a frequency corresponding to the vortex velocity which is proportional to the flow rate of the intake air for the engine to thereby detect the intake air flow rate, injection valve drive means for driving said fuel injection valve for a predetermined period in synchronism with the frequency output signal of said vortex flow meter to thereby effect the fuel injection, pressure regulating means for holding substantially at a predetermined level the difference between the pressure of the fuel to be fed to said fuel injection valve and the pressure in the intake pipe into which the fuel is injected and control means for controlling the fuel injection pressure in accordance with the running state of the engine.

The foregoing and other objects, features and advantages of the present invention will be apparent from the following more particular description of a preferred embodiment of the invention as illustrated in the accompanying drawing.

BRIEF DESCRIPTION OF THE DRAWING

The single drawing is a schematic view of the fuel injection system for an internal combustion engine according to an embodiment of the present invention.

DETAILED DESCRIPTION OF THE INVENTION

In the accompanying drawing, an internal combustion engine 1 is provided with an intake pipe 3 having a throttle valve 2 therein which is under the control of the accelerator pedal of an automobile. A vortex flow meter 4 is connected to the intake pipe and measures the flow rate of the intake air being drawn into the engine 1. A fuel injection valve 5 is located in the intake pipe for injecting fuel into the intake air in synchronism with the frequency output signal of the aforementioned vortex flow meter 4. The fuel injection valve is under the control of an injection valve drive device 6 which in turn is controlled by the frequency output signal of the vortex flow meter 4. An air cleaning device 7 having a filter element 8 is secured to the intake end of the vortex flow meter 4 and an intake air temperature detector 9 is located at the downstream side of the filter element 8 adjacent the intake of the vortex flow meter 4.

The suction side of a fuel pump 11 is connected to a fuel tank 10 by means of a pipe 12. The discharge side of the fuel pump 11 is connected by a pipe 13 to the inlet of a casing 14 which defines a fuel pressure regulating chamber **14*a*. The outlet of the fuel pressure regulating chamber 14*a* is disposed in communication with the fuel injection valve 5 by means of a pipe 15. A second casing 16 is secured to the casing 14 and defines a differential pressure regulating chamber 16*a* which is in communication with the intake pipe 3 through the connecting pipe 17. A diaphragm 17 is secured between the casings 14 and 16 and supports a pressure regulating valve 20. The diaphragm 19 and valve 20 separate the fuel pressure regulating chamber 14*a* from the differential pressure regulating chamber 16*a*. A spring 18 is located within the differential pressure regulating chamber 16*a* for normally biasing the diaphragm 19 and valve 20** to the left as shown in the drawing.

A linear motor comprised of a moving electrical coil 22, a permanent magnet 23, a yoke 25 and a core 24 is located within a motor casing 21 secured to the side of the casing 14 opposite the casing 16. A pressure regulating rod 26 is secured at one end to the movable coil 22 by means of an arm 27 so that the rod 26 can be moved in the direction of the arrows in accordance with the movements of the moving coil 22. The opposite end of the pressure regulating rod extends into the fuel pressure regulating chamber **14*a* with the rod 26 being disposed in slidable airtight engagement with the casing 14. The pressure regulating rod 26 is hollow and is disposed with the end located in the fuel pressure regulating chamber 14***a* abutting against the pressure regulating valve 20 to control the fuel pressure in the pressure regulating chamber 14*a*. The end of the rod 26 in the motor casing 21 is connected through an extendable bellows 28 to a pipe 29 disposed in communication with the fuel tank 10. A coil spring 30 is provided between the motor casing 21 and the arm 27 for normally biasing the rod 26 and the motor coil 27 to the left as viewed in the drawing. An engine temperature detector 31 and the intake air temperature detector 9 are operatively connected to an electronic control device 32 which in turn provides the moving coil 22 with a current which is determined by the output signals of the air intake temperature detector 9 and the engine temperature detector 31.

In the operation of the above-described system, the intake air will flow through the air cleaner 7 into the vortex flow meter 4 when the engine 1 is started. The intake air is introduced into the engine 1 from the intake pipe 3 after its flow rate has been measured by the vortex flow meter 4. The fuel in the tank 10 is pumped into the fuel pressure regulating chamber 14*a* by the fuel pump 11. If the pressure of the fuel thus pumped exceeds a predetermined value, the diaphragm 19 will be moved to the right as viewed in the drawing against the force of the spring 18. At this time, the pressure regulating valve 20 will separate from the end of the pressure regulating rod 26 so that the fuel under high pressure flows through the hollow portion of the pressure regulating rod 26 back to the fuel tank 10 to thereby maintain a predetermined pressure in the chamber 14*a*. When the pressure is lowered, the pressure regulating valve 20 is moved into abutting engagement with the pressure regulating rod 26 by means of the spring 18. In this manner, the fuel pressure in the pressure regulating chamber 14*a* is held substantially at a constant level. The fuel is then fed at the regulated pressured from the pipe 15 to the fuel injection valve 5 for injection into the intake pipe 3. In order to hold the flow rate of the fuel injected at a predetermined value, it is sufficient that the difference in pressure (i.e., the fuel injection pressure) between the fuel pressure in the aforementioned pressure regulating chamber 14*a* and the pressure in the intake pipe 3 into which the fuel is injected be held at a constant level. For this purpose, the pressure in the intake pipe 3 and the pressure in the differential pressure regulating chamber 16*a* are equalized so that the pressure in the intake pipe 3 is exerted upon the diaphragm 19. The operation so far described is similar to that of a conventional system.

The aforementioned fuel injection valve 5 is driven or opened by the injection valve drive device 6 for a predetermined period (e.g., for 4 ms) in synchronism with the frequency of the output signal of the vortex flow meter 4 to inject the fuel into the intake pipe 3. If the intake air temperature or the engine temperature is changed, the electronic control device 32 which receives the output signals of the intake air temperature detector 9 and the engine temperature detector 31, feeds the moving coil 22 with a current corresponding to the temperature change so that the pressure regulating rod 26 is moved in accordance with that current value. As a result, the position in which the pressure regulating valve 20 and the pressure regulating rod 26 abut against each other is shifted so that the fuel pressure in the pressure regulating chamber 14*a* is changed. In other words, the fuel injection pressure to be applied to the fuel injection valve 5 is changed to vary the flow rate of the fuel to be injected.

In summary, the present invention provides a fuel injection system which comprises a fuel injection valve 5 for injecting the fuel under an adjusted pressure into the intake pipe 3 of the engine 1. A vortex flow meter 4 generates a frequency output signal corresponding to the intake air flow rate for the engine and an injection valve drive means 6 for opening the fuel injection valve 5 for a predetermined period is operated in synchronism with the frequency output signal of the vortex flow meter to thereby effect the proper fuel injection. Means are provided for holding substantially at a predetermined level the difference (i.e., the fuel injection pressure) between the pressure of the fuel being fed to the fuel injection valve 5 and the pressure in the intake pipe 3 into which the fuel is injected and electronic means 32 are provided for controlling the difference pressure in accordance with the running state of the engine 1. As a result, the drive time or the period in which the fuel injection valve 5 is open can be made longer than that of conventional systems so that the injection rate of the fuel can be accurately set.

While the invention has been particularly shown and described with reference to a preferred embodiment thereof, it will be understood by those in the art that various changes in form and details may be made therein without departing from the spirit and scope of the invention.

What is claimed is:

1. A fuel injection system for an internal combustion engine comprising a fuel injection valve for injecting fuel under adjusted pressure into the intake pipe of an internal combustion engine, a vortex flow meter adapted to be connected to said intake pipe for generating an output signal at a frequency corresponding to the vortex velocity proportional to the flow rate of the intake air for said engine to thereby measure said intake air flow rate, injection valve drive means for opening said fuel injection valve for a predetermined period in synchronism with said output signal of said vortex flow meter to thereby effect fuel injection, pressure regulating means for holding substantially at a predetermined level the difference between the pressure of fuel being fed to said fuel injection valve and the pressure in said intake pipe into which the fuel is injected and control means for controlling said difference pressure in accordance with the running state of said engine;

wherein said pressure regulating means is comprised of a first pressure chamber having a fuel inlet adapted to be connected to a fuel pump, a fuel output connected to said fuel injection valve and a pressure relief output adapted to return fuel to a fuel tank, a second chamber adapted to be connected for fluid pressure communication with said intake pipe, spring biased moveable valve means separating said first and second chambers in operative association with said fuel relief outlet for controlling the fuel pressure in said first chamber;

wherein said control means is comprised of a hollow pipe extending into said first chamber in an airtight slidable manner to constitute said fuel relief outlet, temperature sensing means for sensing an engine temperature and an intake air temperature to produce an output, and electro-magnetic means for moving said pipe into and out of said first chamber in response to the output of said temperature sensing means for varying its position relative to said moveable valve means; and wherein said electromagnetic means comprises a linearly moving electrical coil which is connected to said hollow pipe so that said pipe is moved in accordance with linear movements of said coil.

* * * * *